United States Patent [19]

Berton et al.

[11] 4,350,399

[45] Sep. 21, 1982

[54] FURNITURE WITH SPACE SAVING DOOR

[75] Inventors: Marcello Berton, Ronchi di Massa; Dino Bertozzi, Massa, both of Italy

[73] Assignee: Ing. C. Olivetti & C., S.p.A., Ivrea, Italy

[21] Appl. No.: 121,978

[22] Filed: Feb. 15, 1980

Related U.S. Application Data

[63] Continuation of Ser. No. 920,072, Jun. 28, 1978, abandoned.

[30] Foreign Application Priority Data

Jul. 13, 1977 [IT] Italy ..... 68623 A/77

[51] Int. Cl.[3] ..... A47F 3/00

[52] U.S. Cl. ..... 312/138 R; 312/258; 312/320; 160/159; 160/206; 160/186

[58] Field of Search ..... 160/135, 186, 136, 137, 160/138, 159, 165, 206; 312/259, 260, 261, 297, 138 R, 258, 320

[56] References Cited

U.S. PATENT DOCUMENTS

| | | | |
|---|---|---|---|
| 702,146 | 6/1902 | McCloud | 160/147 |
| 2,754,902 | 7/1956 | Attkisson | 160/196 |
| 2,952,312 | 9/1960 | Young et al. | 160/159 |
| 3,294,464 | 5/1965 | Lew | 312/258 |
| 3,403,954 | 10/1968 | Williams | 312/297 |
| 4,014,377 | 3/1977 | Kochanowski | 160/186 |

*Primary Examiner*—C. J. Husar
*Assistant Examiner*—Cherney S. Lieberman
*Attorney, Agent, or Firm*—Schuyler, Banner, Birch, McKie & Beckett

[57] ABSTRACT

A furniture is provided of a door formed by a series of uniformly sized panels which are movable from a closed position, in which they are coplanar one with another, to an open position, in which they are parallel and folded on one side of the furniture itself. The panels are connected together by means of a parallelogram linkage system which allows the panels to be moved from the closed position to the open position by means of a single control. The panels slide in an upper guide and a lower guide of the furniture and fold onto the left hand side of the furniture, allowing full access to the furniture itself. The parallelogram system comprises two sets of rods which are substantially identical and arranged between an upper side of the panels and the upper guide of the furniture and between a lower side of the panels and the lower guide, respectively.

1 Claim, 7 Drawing Figures

FURNITURE WITH SPACE SAVING DOOR

This is a continuation of application Ser. No. 920,072, filed June 28, 1978, now abandoned.

BACKGROUND OF THE INVENTION

The present invention relates to a piece of furniture occupying a reduced space, in which the door is formed of panels which are movable from a closed position in which they are all complanate to an open position in which they are folded on one or more sides of the piece of furniture itself.

SUMMARY OF THE INVENTION

The technical problem which the present invention proposes to resolve is that of producing a piece of furniture, in particular for an office, which has a space-saving door, which is reliable, of a modest cost and which allows total access to and full use of the inside of the piece of furniture itself.

This technical problem is resolved by the multi-panel space-saving door in accordance with the invention, which is characterised by each of the said panels being fitted with a pair of pivots sliding in corresponding guides of the said piece of furniture and by two adjacent panels being connected together by means of a parallelogram linkage system which allows the two panels to be moved from the closed position to the open position by means of a single control.

BRIEF DESCRIPTION OF THE DRAWING

A preferred form of embodiment of the invention is shown in the following description which is given for purposes of illustration, but is not restrictive, with reference to the attached drawing, in which.

DESCRIPTION OF THE PREFERRED EMBODIMENT

Figure 1:
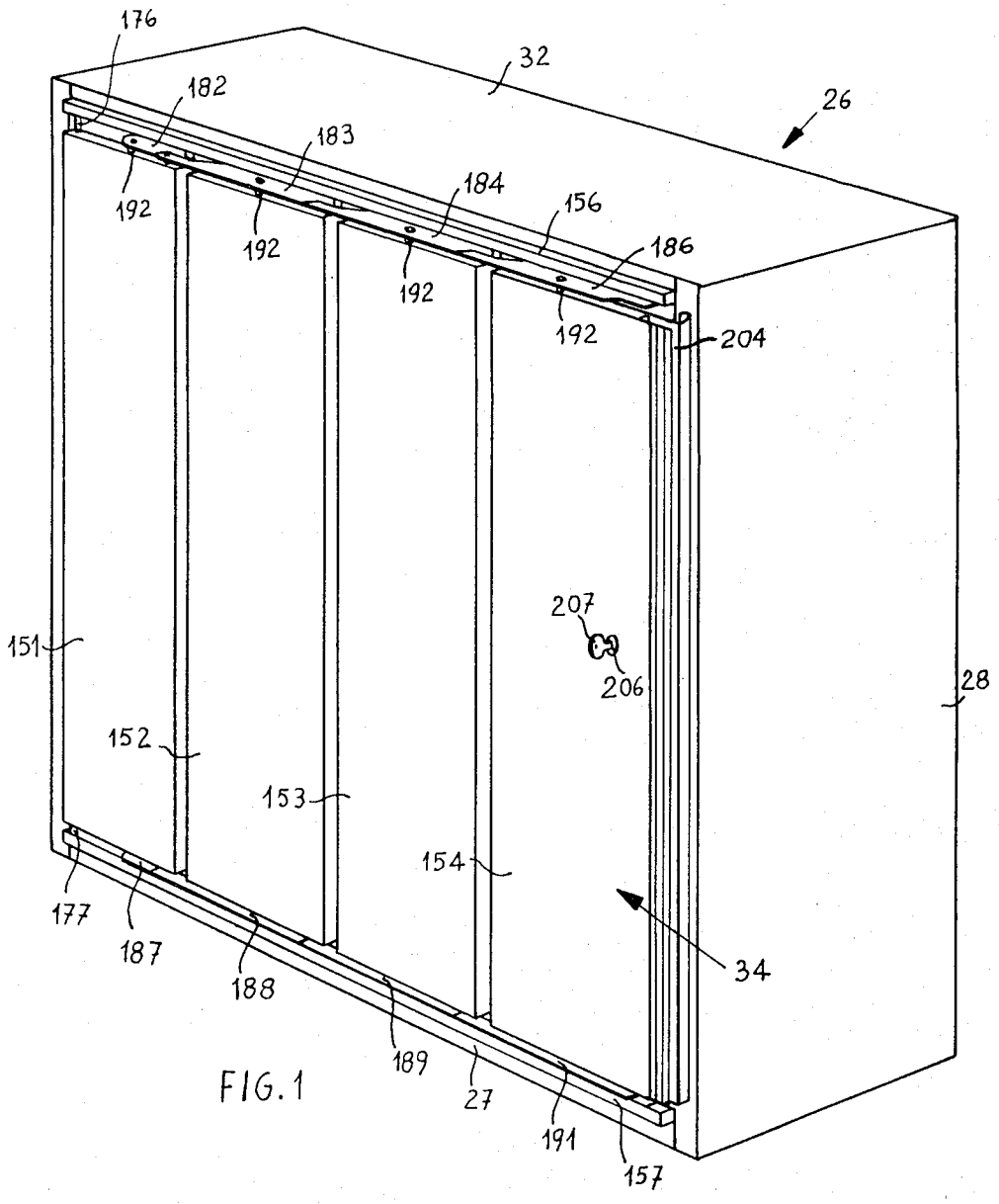
FIG. 1 shows a perspective view of a piece of furniture with a space saving door in accordance with the invention.
Figure 2:
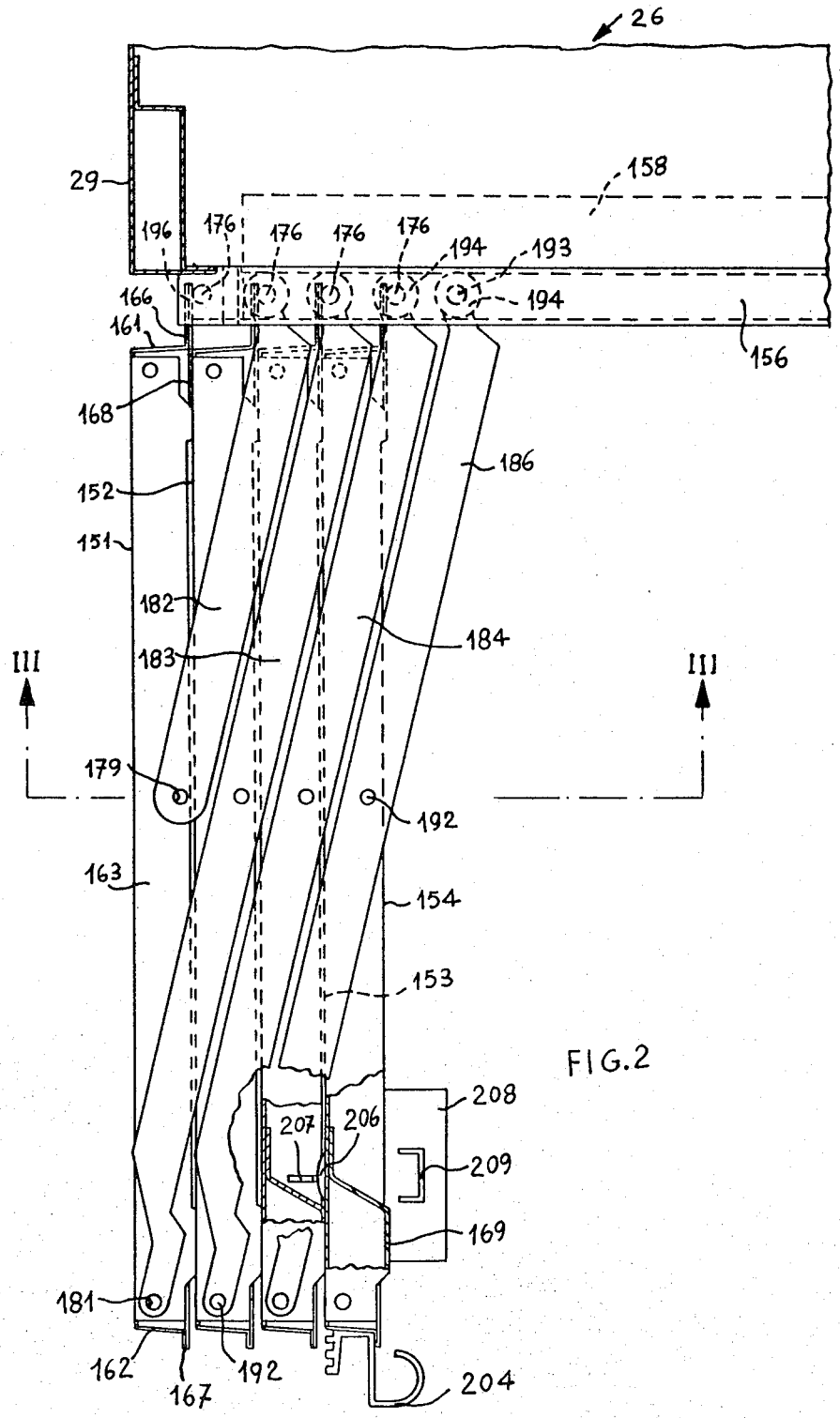
FIG. 2 shows a partial plan view of the door in FIG. 1 in a working position.

With reference to FIG. 1, the space saving door 34 is applied to a piece of furniture 26 which includes a base 27, two identical side walls 28 and 29 (FIG. 2) and a top 32 (FIG. 1). The door 34 can be opened from right to left or vice versa and consists of a series of panels, the number of which varies with variations in the dimensions of the piece of furniture 26. In the following description, the door 34 opens from right to left and is formed of a series of four panels 151, 152, 153 and 154, of which panel 151 is the fixed or initial one and panel 154 the end one.

Figure 6:
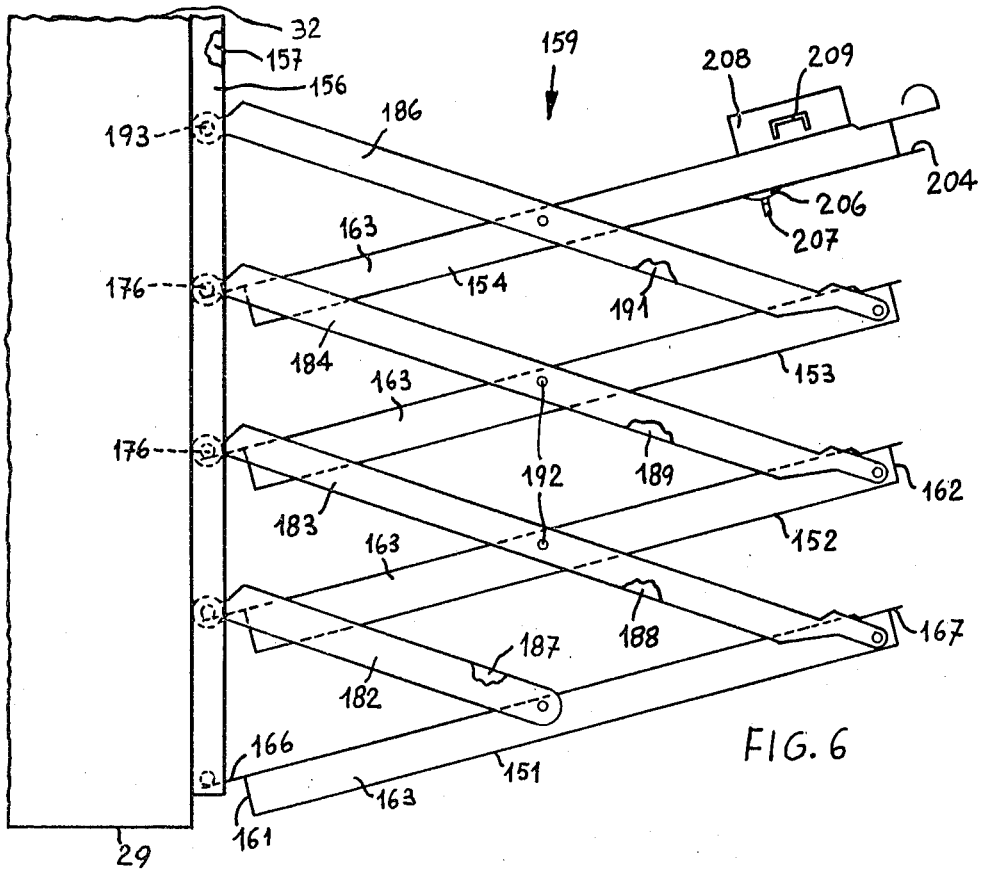
FIG. 6 shows a partial diagrammatic plane view of the door in a second working position.

The space-saving door 34 slides in an upper guide 156 and a lower guide 157 which are fixed by two plates 158 (FIG. 2) to the top 32 (FIG. 1) and to the base 27 (a single plate is visible), outside the casing of the piece of furniture 26 and by means of a parallelogram linkage system, shown generically as 159 (FIG. 6). This system folds onto the left hand side of the piece of furniture 26 (FIG. 2) allowing full access to the piece of furniture itself.

Figure 3:
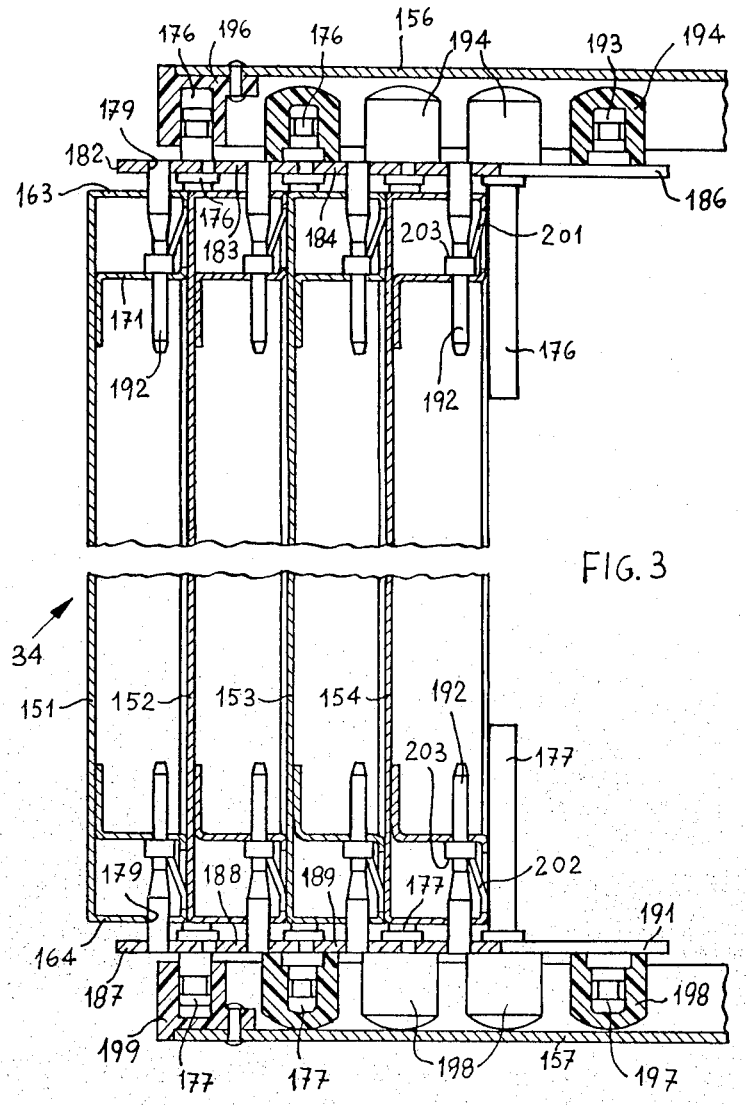
FIG. 3 shows a partial section on the line III—III in FIG. 2.
Figure 4:
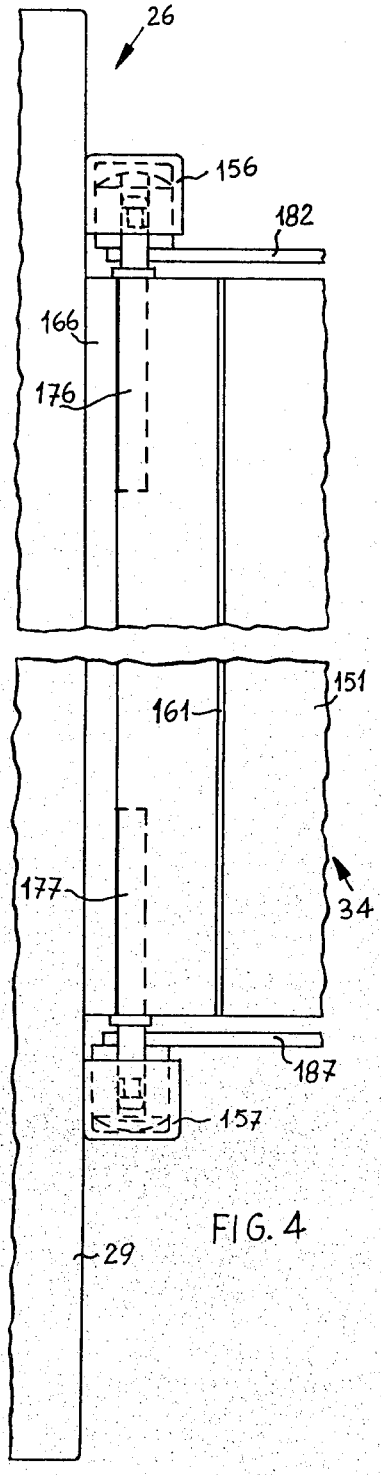
FIG. 4 shows a partial side view of FIG. 2.

The panels 151, 152, 153 and 154 are substantially identical to one another and, therefore, for clarity and simplicity, only panel 151 will be described. The initial panel 151 is formed of a sheet of metal folded to define the borders of two side walls 161 and 162, an upper edge or wall 163 and a lower edge or wall 164 (FIG. 3). The side walls 161 (FIG. 2) and 162 are folded to define the borders of an edge 166 and 167 respectively and a box 168 and 169 respectively which are able to strengthen panel 151 vertically. The upper 163 and lower 164 walls (FIG. 3) are folded to define the borders of a box which is able to strengthen and reinforce panel 151 horizontally. Each panel 151, 152, 153 and 154 has on the upper 163 and lower 164 walls a series of holes 179 and 181 which are able to engage with the parallelogram system 159 (FIG. 6).

The parallelogram system 159 includes two sets of rods which are substantially identical one with another and which are arranged in parallel: one set includes a semi-rod 182 and three rods 183, 184 and 186 arranged between the upper wall 163 (FIG. 3) and the upper guide 156, while the other set includes a semi-rod 187 (FIG. 6) and three rods 188, 189 and 191, arranged between the lower wall 164 (FIG. 3) and the lower guide 157. Each of the two sets of rods consists of a section which is substantially flat and rectilinear and which is fitted at the ends with two projections which are turned from a reciprocally opposite part in relation to the rectilinear part.

The semi-rod 182 is connected at one end by an intermediate fulcrum or pivot 192 which is housed in the hole 179 in the upper wall 163 of the panel 151 and, at the other end, to the fixed pivot 176 (FIG. 2) in the panel 152. The rod 183 is connected at a projection of one end by a terminal fulcrum or pivot 192 housed in the hole 181 of the upper wall 163 of the panel 151 and, at the other projection of the end to the pivot 176 in the panel 153 and by an intermediate fulcrum or pivot 192 housed in the hole 179 of the upper wall 163 of the panel 152. The rod 184 is connected at one end by a terminal fulcrum or pivot 192 housed in the hole 181 of the upper wall 163 of the panel 152, at the other end to the pivot 176 in the panel 154 and by an intermediate fulcrum or pivot 192 housed in the hole 179 of the upper wall 163 of the panel 153. The rod 186 is connected at one end by a terminal fulcrum or pivot 192 housed in the hole 181 of the upper wall 163 of the panel 153, by an intermediate fulcrum or pivot 192 housed in the hole 179 of the upper wall 163 of the end panel 154 and, at the other end, by means of a pivot 193 housed in a runner 194 of a set of runners 194 which house the pivots 176 of the panels 152, 153 and 154. The pivot 176 of the panel 151 is, however, housed in a hinge 196 (FIG. 3) which forms an integral part of the upper guide 156. The runners 194 are housed to run smoothly and are guided by the upper guide which is substantially of a U Shape.

In the same way as is described above, the semi-rod 187 is connected at one end by a intermediate fulcrum or pivot 192 which is housed in the hole 179 of the lower wall 164 of the panel 151 and at the other end, to the pivot 177 of the panel 152. The rod 188 is connected at one end by a terminal fulcrum or pivot 192 housed in the hole 181 of the lower wall 164 of the panel 151 and, at the other end, to the pivot 177 of the panel 153 and by an intermediate fulcrum or pivot 192 housed in the hole 179 of the lower wall 164 of the panel 152. The rod 189 is connected at one end by a terminal fulcrum or pivot 192 housed in the hole 181 of the lower wall 164 of the panel 152 and at the other end, to the pivot 174 of the panel 152 and by an intermediate fulcrum or pivot 192 housed in the hole 179 in the lower wall 164 of the panel 153. The rod 191 is connected at one end by a terminal fulcrum or pivot 192 housed in the hole 181 in the lower wall 164 of the panel 153, by an intermediate fulcrum or pivot 192 housed in the hole 179 of the lower wall 164 of the panel 154 and, at the other end, by means of a pivot 197 housed in a runner 198 of a set of runners 198 which house the pivots 177 of the panels 152, 153 and 154. The pivot 177 of the panel 151 is, however, housed in a hinge 199 similar to the hinge 196 which forms an integral part of the lower guide 157. The runners 198 are housed to run smoothly and are guided in the lower guide 157 which is substantially of a U shape.

The fulcrums or pivots 192 are idential and are fixed immoveably in the boxes 171 and 172 by means of blades 201, 202 respectively which come up against a shoulder 203 of the pivots 192.

Fitting of the panels 151, 152, 153 and 154 with the parallelogram system 159 on to the piece of furniture 26 (FIG. 1) is done as follows:

The semi rods 182 (FIG. 3) and the rods 183, 184 and 186 are assembled with the pivots 192 on the upper wall 163 of the panels 151, 152, 153 and 154 and then the runners 194 are slipped into the pivots 176 and 193. The semi-rod 187 and the rods 188, 189 and 191 are assembled with the pivots 192 on the lower walls 164 of the panels 151, 152 153 and 154 and then the runners are slipped onto the pivots 177 and 197. The upper guide 156 is now arranged with the hinge 196 slipped onto the pivot 176 of the panel 151 and with the runners 194 housed in the guide itself. The lower guide 157 is arranged in an identical way with the hinge 199 slipped on to the pivot 177 of the panel 151 and with the runners 198 housed in the guide itself. The panels 151, 152, 153 and 154 thus assembled are now fitted with the guides 156 and 157 on to the piece of furniture 26 (FIG. 2) so as to fix the plates 158 of the guides 156 and 157 to the top 32 (FIG. 1) and to the base 27.

The door 34 is thus fitted on to the piece of furniture 26 and is supported with the runners 198 (FIG. 3) on the guide 157. By acting on a handle 204 (FIG. 2) which is fixed along the edge 162 of the panel 154, the door 34, the panels 151, 152, 153 and 154 of which are complanate one with another in the closed position, moves from right to left and, by means of the parallelogram system 159, is articulated in the way shown in FIG. 5 until it folds up on the left side of the piece of furniture 26 allowing access to the piece of furniture itself.

The runners 194 and 198 (FIG. 3) can slide longitudinally inside the guides 156 and 157 but cannot move to and fro transversely. Moreover, since they are connected by the pivots 176 and 177 to the respective bars 182, 183, 184, 186, 187, 188, 189 and 191 to at least two different panels by means of the pivots 192, the door 34 cannot tilt over during its movement from right to left or vice versa. In fact, the panels 151, 152, 153 and 154 with the parallelogram system 159, and the runners 194 and 198 with the guides 156 and 157 form a unit which, at one and the same time involves all the panels and stands up to any distorting action. The unit is, therefore, solid and safe, the door 34 can slide only longitudinally and cannot become warped and, consequently, any jamming during the working of the door is prevented.

Figure 5:
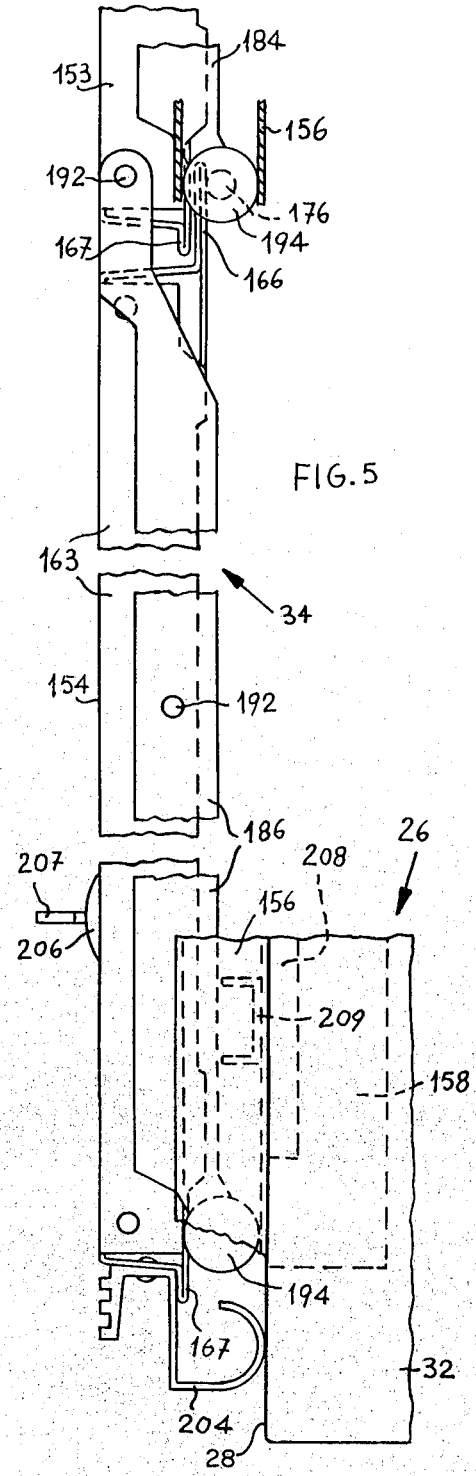
FIG. 5 shows a partial plan view of the door in FIG. 1.

When it is in the closed position, the door 34 can, as shown in FIG. 5, be closed by a closing device 206 which includes a key 207 and a cremorne bolting mechanisim 208 of a known type and not described here, which has two U shaped bars (only one visible in the drawings) which are able to be housed in suitable seatings of the upper 156 and lower 157 guides to prevent the door itself from opening.

It is agreed that it is possible to introduce amendments and improvements to the piece of furniture with the space saving door both in the form and in the arrangement of the various parts, without departing from the scope of the invention. For example, the number of panels which make up the door can vary depending on the dimensions of the piece of furniture.

The panels can slide in the upper and lower guides housed inside the piece of furniture itself.

The panels and rods can work in the opposite way to the example described above, ie., the end panel can have the handle in correspondence with the sliding pivot and can be connected to the adjacent panel by means of a semi-rod which connects the intermediate fulcrum of the end panel with the sliding pivot of the adjacent panel. Furthermore, the end fulcrum of the end panel is connected by a rod to the intermediate fulcrum of the adjacent panel and to the sliding fulcrum of the third panel. The pivot of the fixed panel is, in fact, no longer fixed to the hinge of the guides but is also sliding while the pivot of the corresponding rod, which, in its turn is supported on the intermediate fulcrum of the fixed panel and on the end fulcrum of the panel adjacent to the fixed panel, is supported on the hinge.

Figure 7:
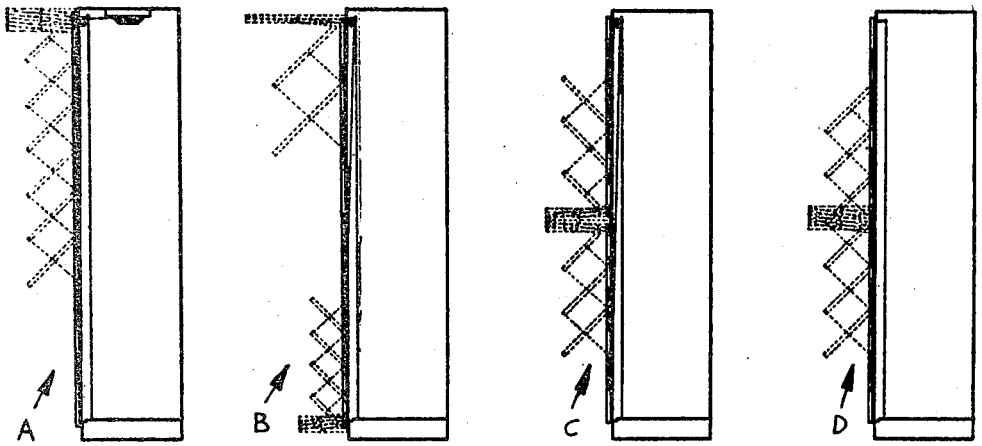
FIG. 7 shows certain variants of the piece of furniture in FIG. 1.

The panels can be arranged horizontally with opening taking place towards the top of the piece of furniture and with the panels folded level with the top as shown at A in FIG. 7. Their weight is balanced by a cone-shaped pulley system which winds around a steel cable and is controlled by a coil spring housed in the drum fitted above the pulley.

The panels can be formed of two upper panels and four lower panels of half a width, balanced reciprocally by a transmission and a steel cable and opening takes place half upwards towards the top and half downwards towards the bottom as shown at B in FIG. 7.

In a final example, the door is formed of a group of three independent panels in which the two central ones are pivoted on the sides of the piece of furniture and balance one another reciprocally by means of a transmission and a steel cable as shown at C in FIG. 7.

Finally, the door can be formed of a single group of 6 panels in which only one is hinged at the centre of the piece of furniture. Balancing occurs automatically between the two panels which lower and the three which rise as shown at D in FIG. 7.

In the two latest examples C and D of FIG. 7, the panels which are folded at the centre of the piece of furniture are arranged parallel to the top and to the base and form a face or a working surface.

What we claim is:

1. A piece of furniture with two side parts, upper and lower parts having substantially coplanar front edges, and a space saving door comprising:

a series of panels of equal size each formed of a sheet of folded metal including a pivoted vertical edge having a projecting border on an inner side of the panel, a pair of first terminal pivots connected vertically to said projecting border, a free edge opposite to the pivoted edge and a pair of other edges interconnecting the pivoted edge with the free edge and including a pair of intermediate pivots located on said other edges between said pivoted edge and said free edge and a pair of second terminal pivots adjacent to said free edge, and wherein said first terminal pivots extend above and below said other edges;

guide means for guiding the first terminal pivots of said panels;

pairs of parallelogram means connecting said first and second terminal pivots and said intermediate pivots for moving said panels from a closed position in which the panels are coplanar, to an open position in which the panels are folded and extend outwardly adjacent one of said two side parts of the furniture; and means for facilitating the coplanarity of said panels parallel to the front edges of said upper and lower parts when closed and avoiding jamming upon opening, said means comprising a pair of hinges fixed on the front edges of said upper and lower parts and adjacent to the front edge of one of said side parts, wherein said pair of hinges fixedly hinge the first terminal pivots of a first panel of said series adjacent to the front edge of said one of said two side parts, wherein the second terminal pivots are disposed on said other edges adjacent to an outer side of the panel opposite to said inner side, and wherein said parallelogram means comprises a series of pairs of rods, each pair having a rectilinear central portion connected with the intermediate pivots and two ends which are offset project on opposite sides with respect to said rectilinear portion and which connect said first and second terminal pivots, and wherein the last panel of said series comprises a handle adjacent to its free edge;

said guide means comprising a pair of guides having a U section arranged horizontally in the front edges of said upper and lower parts for guiding the pair of first terminal pivots of said panels except the first panel to slide and pivot on said guide means so that the other edges of the panels remain parallel, and causing one of the two ends of each rod of said pair of rods to face to the other end of the two ends of an adjacent rod of an adjacent pair of said rods, the rectilinear parts of said rods of each pair to be aligned and substantially parallel to the panels in the closed position of the panels and confined between said guides and the edges interconnecting the pivoted edge with the free edge, and the free edges of said panels to be arrested by an outer side of the borders of the other adjacent panels in the closed position of the panels, and wherein said handle is configured to be operated for rotating said last panel to facilitate the closing and opening of said panels; and wherein said guide means comprise a pair of guides arranged horizontally in upper and lower extremities of the furniture, respectively, wherein each of said first terminal pivots comprises a vertical stud having a projecting end wherein each end except the ends of the first panel is housed in a runner, wherein the U-section of each guide comprises bottom and lateral sides to accommodate said runners and wherein said runners are guided by the lateral sides of the U-section of the upper guide and are provided in the lower part thereof with spherical cups which are engaged with the bottom side of the corresponding lower U-section to slidably support the weight of said other panels on opening and closing thereof, and wherein said hinges are fixed to the ends of said pair of guides adjacent to the front edge of said one of said two side parts.

* * * * *